US006319161B1

(12) United States Patent
Martinez et al.

(10) Patent No.: US 6,319,161 B1
(45) Date of Patent: Nov. 20, 2001

(54) ARROWHEAD AND METHOD OF MAKING

(76) Inventors: Fermin Martinez, 20607 Partello Rd., Marshall, MI (US) 49068; Scott Martin, 26412 H Dr. North, Albion, MI (US) 49224

( * ) Notice: Subject to any disclaimer, the term of this patent is extended or adjusted under 35 U.S.C. 154(b) by 0 days.

(21) Appl. No.: 09/533,751

(22) Filed: Mar. 23, 2000

(51) Int. Cl.[7] ..... F42B 6/08
(52) U.S. Cl. ..... 473/583
(58) Field of Search ..... 473/582, 583, 473/584

(56) References Cited

U.S. PATENT DOCUMENTS

| | | | |
|---|---|---|---|
| D. 184,538 | 3/1959 | Santry | D22/115 |
| 2,874,968 | 2/1959 | Zielinski | 473/583 |
| 3,604,708 | 9/1971 | Brozina | 473/584 |
| 3,897,062 | 7/1975 | Christensen | 473/583 |
| 4,502,692 | 3/1985 | Humphrey | 473/586 |
| 4,534,568 | 8/1985 | Tone | 473/583 |
| 4,565,377 | 1/1986 | Troncoso, Jr. et al. | 473/584 |
| 5,257,809 | 11/1993 | Carrizosa | 473/584 |
| 5,911,640 | 6/1999 | Breitwieser et al. | 473/584 |

*Primary Examiner*—John A. Ricci

(57) ABSTRACT

An arrowhead includes a penetrating tip at a leading end, an elongated core member having plurality of axially extending slots, and a plurality of cutting blades with an axially extending base of each blade received in a respective slot. The spiral cutting edges of the blades extend spirally in the same direction about the arrowhead and overlap circumferentially in a manner to collectively define a generally circular cutting envelope when the arrowhead rotates in flight.

11 Claims, 9 Drawing Sheets

ARROWHEAD AND METHOD OF MAKING

FIELD OF THE INVENTION

The present invention relates to a hunting arrowhead and to arrowhead blades configured to produce a large size cutting hole in the animal to promote profuse bleeding.

BACKGROUND OF THE INVENTION

Hunting arrowheads having multiple metal cutting blades referred to commonly as broadheads are known and described in U.S. Pat. Nos. 2,874,968; 3,604,708; 3,897,062; 4,534,568; 4,565,377; 5,257,809; and 5,911,640. Some hunting arrowheads have been employed to provide a cutting pattern in the animal's body to promote profuse bleeding. Various blade configurations have been tried to this end.

An object of the invention is to provide arrowhead blades with a blade configuration effective collectively to provide a large generally circular cut in the animal's body when the arrowhead penetrates the animal's body to promote profuse bleeding from the wound and a quick kill.

Another object of the invention is to provide an arrowhead with blades that improve aerodynamic arrow flight and reduces windage and elevation errors.

Still another object of the invention is to provide an improved method of making such arrowhead blades with the desired configuration.

SUMMARY OF THE INVENTION

An arrowhead pursuant to an embodiment of the invention includes a penetrating tip at a leading end, an elongated slotted member having plurality of axially extending slots, and a plurality of the cutting blades with an axially extending base of each blade received in a respective slot. The cutting edges of the blades extend spirally in the same direction about the arrowhead and overlap circumferentially in a manner to collectively define a generally circular cutting envelope when the arrowhead rotates in flight.

In another embodiment of the invention, a blade for an arrowhead is provided and includes an elongated, axially extending base adapted to be received in a slotted member of the arrowhead and a spiral cutting blade edge intersecting the base proximate the forward end. The blade includes a rear end having a circumferentially extending rear base defined by a radius along its length between the axial-extending base and the spiral cutting edge at their rear ends. The spiral cutting edge extends in a circular arc along its length when viewed in end elevation looking at the forward end.

The invention provides a method of making the cutting blade from a one-piece metallic sheet by a unique combination of bending steps to impart the desired features to the cutting blade.

The above objects and advantages of the invention will become more readily apparent from the following description taken with following drawings.

DESCRIPTION OF THE INVENTION

Figure 2:
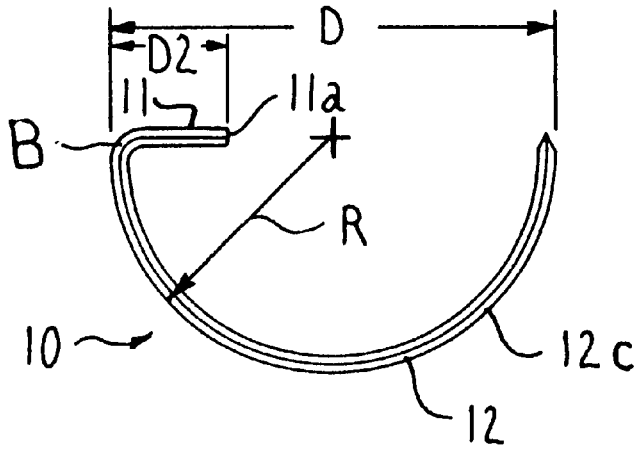
FIG. 2 is an end elevational view looking from the forward end toward the rear end.
Figure 1:
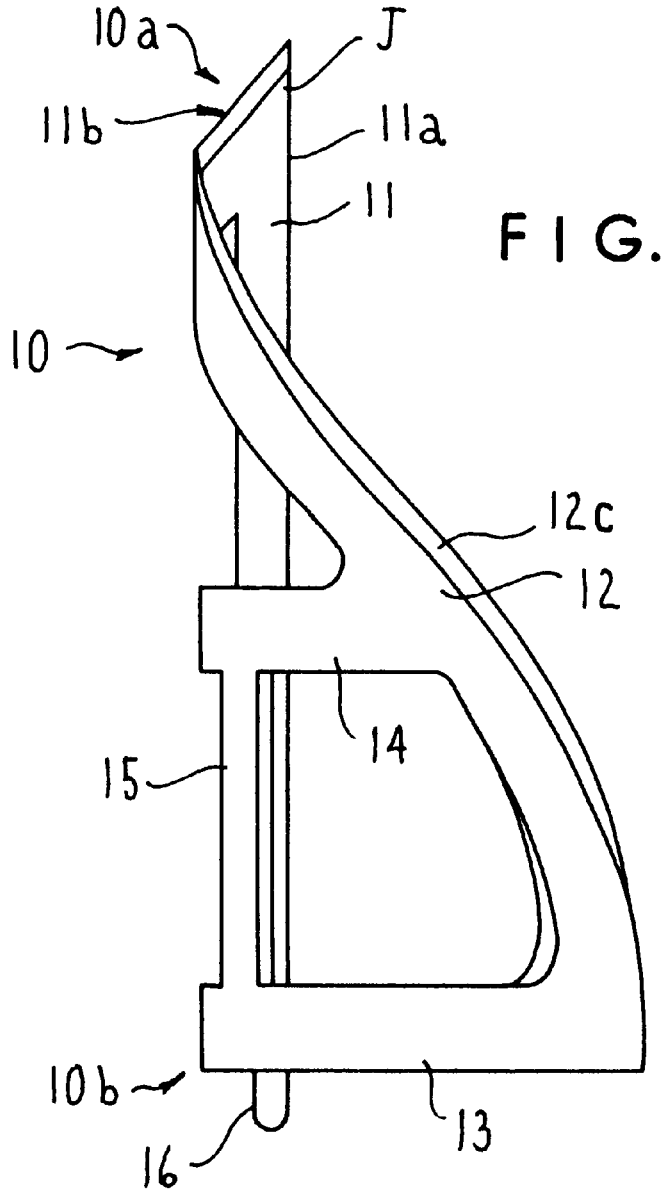
FIG. 1 is an elevational view of a cutting blade pursuant to an embodiment of the invention.

Referring to FIGS. 1–4, an arrowhead cutting blade 10 pursuant to an embodiment of the invention is provided having a forward or leading end 10*a* defined by a generally triangular tip or juncture J where an elongated, axially extending base 11 and a spiral cutting blade edge 12 intersect proximate forward end 10*a*. The axially extending base 11 of each cutting blade 10 includes a free inner, axial straight edge 11*a* adapted to be received in a respective axial slot 20*a* of a conventional broadhead axially slotted core member 20 that is disposed between a fluted arrowhead leading penetrating tip 22 and an arrow shaft 24, FIG. 3A. The tip 22 typically is threaded, press fit or otherwise fastened to the end of the core member 20. The axially extending base 11 includes a bi-beveled straight cutting edge 11*b* at its forward or leading end that joins or blends with the spiral cutting edge 12 where the base 11 is bent as described below. The arrowhead is shown including three cutting blades 10 disposed on core member 20.

Figure 4:
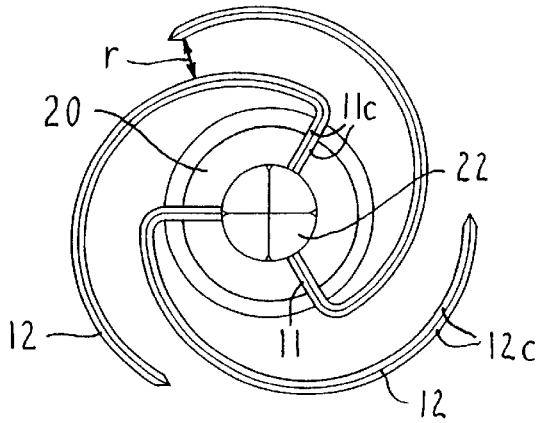
FIG. 4 is an end elevational view taken in the direction of the arrowhead tip.

The spiral cutting edges 12 of blades 10 extend in spiral manner in the same direction about the elongated, axially slotted core member 20. The cutting edges 12 circumferentially overlap one another as they spiral about the core member 20. Although the cutting edges circumferentially overlap, they do not touch; for example, as shown in FIG. 4, a radial distance, r, of less than 1 mm (millimeter), typically about 0.5 to less than 1 mm, is provided between the overlapped edges 12. Each spiral cutting edge 12 comprises a bi-beveled edge formed by grinding or otherwise to define intersecting edge bevels 12*c* along its length, FIG. 2.

When viewed in end elevation toward the arrowhead leading tip 22, FIG. 4, each spiral cutting edge 12 defines substantially a circular arc. For example, when three cutting blades are present as shown, each cutting edge 12 defines a circular arc of about 178–179 degrees about the periphery of the core member 20 when viewed in end elevation, FIG. 4. Three cutting edges 12 thus collectively define a generally circular cutting envelope or profile about the slotted core member 20 when the arrowhead rotates in fight.

The axially extending base 11 of each blade 10 extends transversely of the longitudinal axis of the spiral cutting edge 12 in part along a diameter of the circle arc defined by the spiral cutting edge 12 when viewed in end elevation in a direction from the tip 22 toward the core 20 as illustrated in FIG. 2.

Each cutting blade 10 includes a rear end 10*b* including a partial circumferential arcuate rear base 13 defined by a radius along its entire length between the axial-extending base 11 and the spiral cutting edge 12 at their rear ends. Each rear base 13 intersects the respective cutting edge 12 and axially extending base 11 at their rear ends. Each rear base 13 defines a circular arc having an arc length corresponding to the circular arc length of the cutting edge 12 when viewed in end elevation.

The cutting blade 10 further includes an arcuate connecting web 14 that extends circumferentially between the axially extending base 11 and the spiral cutting edge 12 at an intermediate axial location between the forward end 10*a* and rear end 10*b* of the cutting blade. The web 14 is radius-defined along its circumferential length. An axially extending connecting web 15 is provided to extend between the intermediate connecting web 14 and the partial circumferential rear base 13 of each cutting blade. The web 15 is radius-defined in a direction across its circumferential width. The radii of the webs 14, 15 are equal to the radii of the circular arc that is defined by the cutting edges 12 and rear base 13 when viewed in end elevation. Webs 14 and 15 reinforce the cutting blade.

Figure 3A:
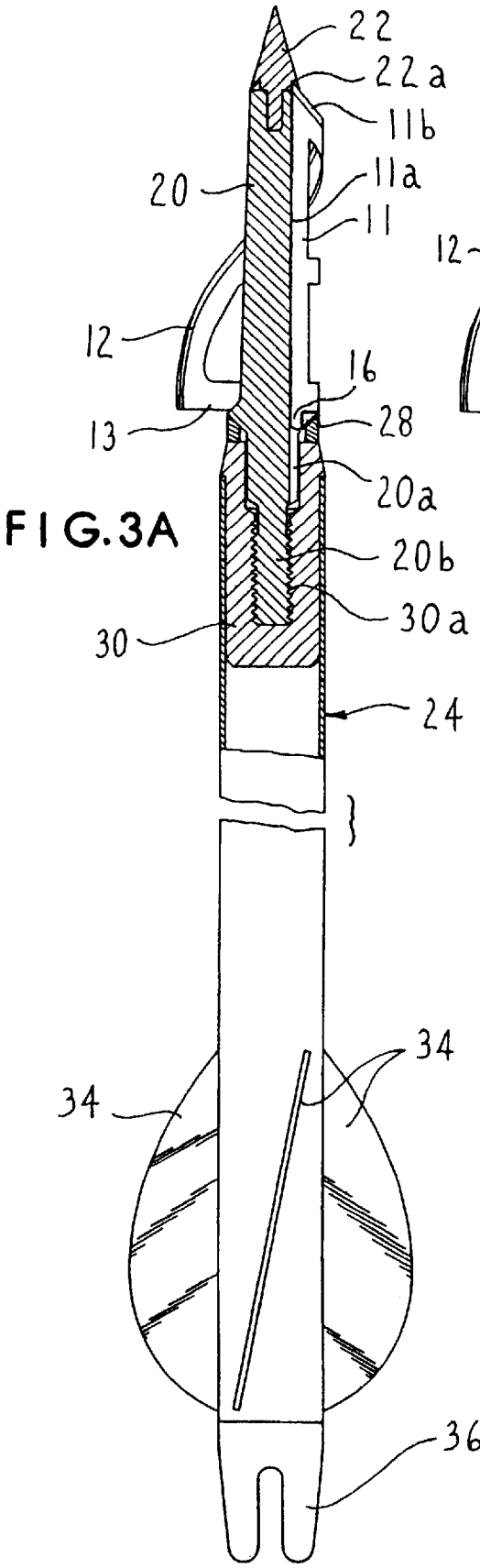
FIG. 3A is an elevational view of an arrow with an arrowhead leading region shown in section.
Figure 1A:
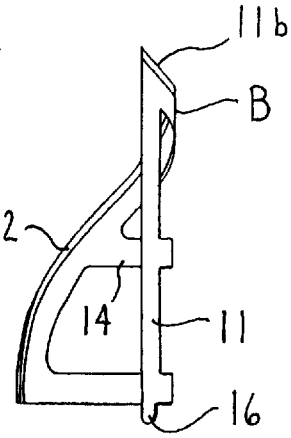
FIG. 1A is an elevational view of the cutting blade of FIG. 1 taken 180 degrees therefrom.

A plurality of the cutting blades 10 are positioned on the slotted core member 20 with the free base edge 11*a* of each cutting blade received in a respective slot 20*a* of the core, FIG. 3A. The juncture or tip J of each cutting blade 10 is received under an overhang 22*a* of the leading penetrating tip 22 and an integral rear tang or tab 16 of each base 11 is received and trapped in annular collar 28 disposed on the core 20, FIG. 3A, when the threaded shank 20*b* of core 20 is threadably tightened into the threaded bore 30*a* of arrow shaft insert 30. That is, the core 20 with the cutting blades 10 positioned thereon is threaded into the insert 30 until the cutting blades 10 are trapped or locked between the leading tip 22 and the collar 28 as shown in FIG. 3A. The spiral cutting edges 12 spiral in a direction that will inherently tighten the threaded joint between the core member 20 and the insert 30 during arrow flight and impact.

Figure 3:
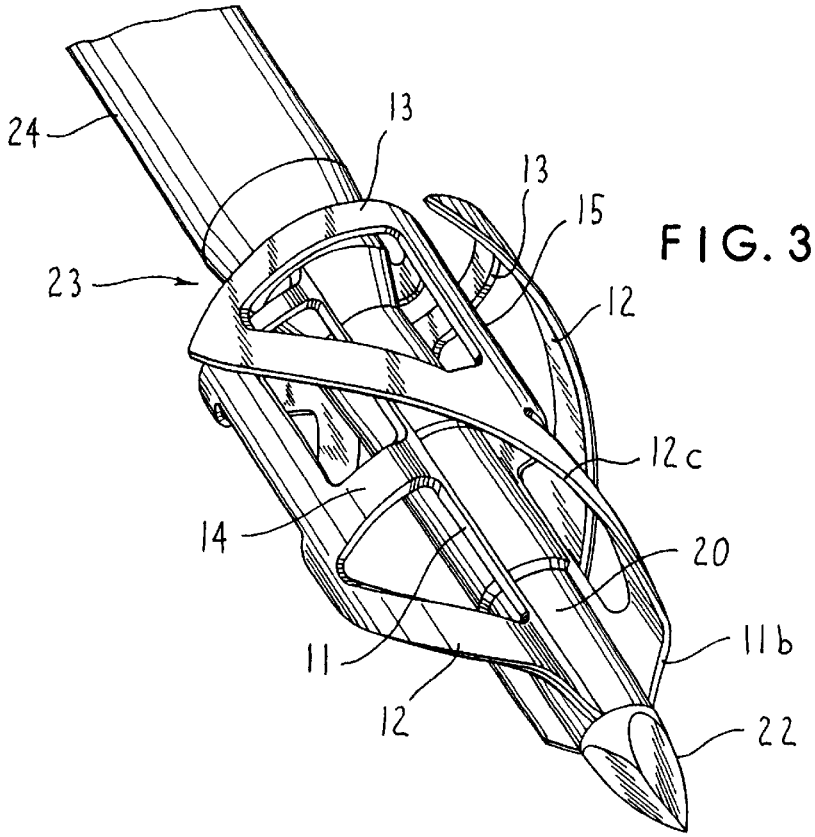
FIG. 3 is a perspective view of the cutting blades on a core member between an arrowhead tip and arrow shaft.

The core member 20 can have a cross-section that increases in diameter in steps along its axial length as illustrated in FIG. 3. Alternately, the core member 20 can have non-stepped cross-section as illustrated in FIG. 3A with the cross-section gradually increasing, or constant, in diameter.

The insert 30 is press fit or otherwise fastened in an end of a conventional hollow arrow shaft 24 made of metal (e.g. aluminum, steel) wood, carbon composite, plastic or other suitable material and having a plurality of circumferentially spaced apart stabilizing vanes 34 and a rear string nock 36 to receive the bow string. The vanes 34 increase rotational spinning and stabilization of the arrow when it is in flight after being shot from a bow as is well known.

When the cutting blades 10 are so trapped or locked in position on the slotted core member 20 between the arrowhead tip 22 and the collar 28, the cutting blades 10 are disposed about the outer circumference of the core member 20 with the spiral cutting edges 12 extending spirally thereabout in the same direction and with the rear bases 13 extending circumferentially in the same direction about the core member 20. The cutting edges 12 overlap circumferentially, FIGS. 3 and 4, to collectively form a substantially circular cutting profile when the arrowhead rotates in flight. The rear bases 13 overlap circumferentially to define the trailing end 23 of the arrowhead with a generally circular profile when viewed in end elevation in a direction toward the trailing end 23. An arrowhead with blades 10 exhibits improved aerodynamic arrow flight with reduced windage and elevation errors.

The fluted tip 22, the base cutting edges 11*b*, and the spiral cutting edges 12 thereby will cut a large circular profile hole in the animal as the arrowhead penetrates the skin of the animal shot with the arrow. The large circular cutting hole promotes profuse bleeding of the animal for a quick kill. Although three cutting blades 10 are shown in FIG. 3, the invention can be practiced with multiple cutting blades 10.

Figure 5:
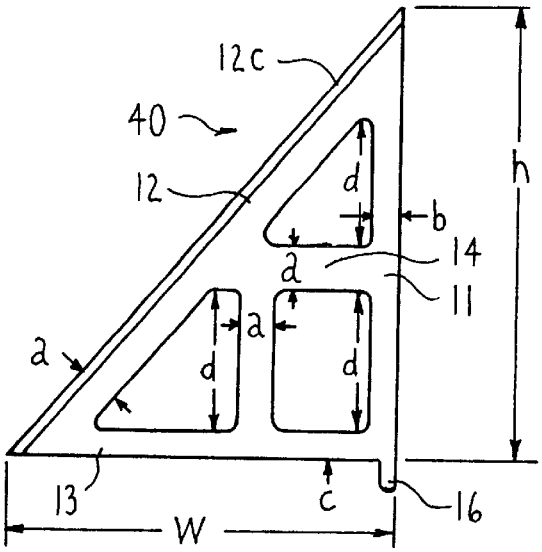
FIG. 5 is an elevational view of the flat cutting blade blank before bending.

In practicing an illustrative embodiment of the invention, the cutting blades 10 are made of type 302 stainless steel sheet (or any other suitable material) and are formed from a blank 40, FIG. 5, having dimensions in millimeters (mm) where a=3.00 mm b=2.00 mm c=2.50 mm d=11.00 mm h=34.00 mm w=29.00 mm The tang 16 is 1 mm in width and 2.5 mm in axial length.

Figure 6:
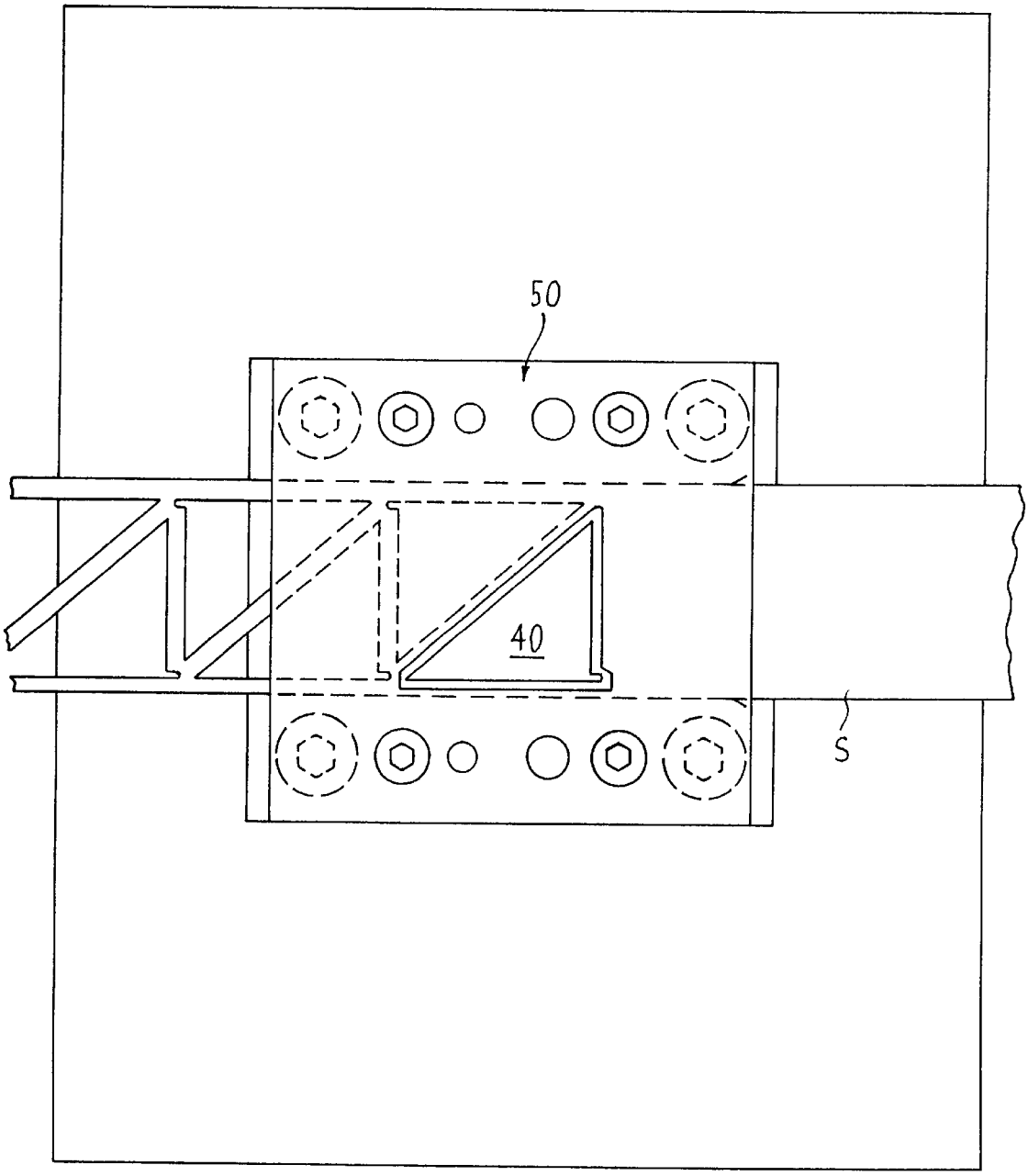
FIG. 6 is a plan view showing a strip of stainless steel on a stamping die after blanks of the cutting blades are stamped therefrom.
Figure 7:
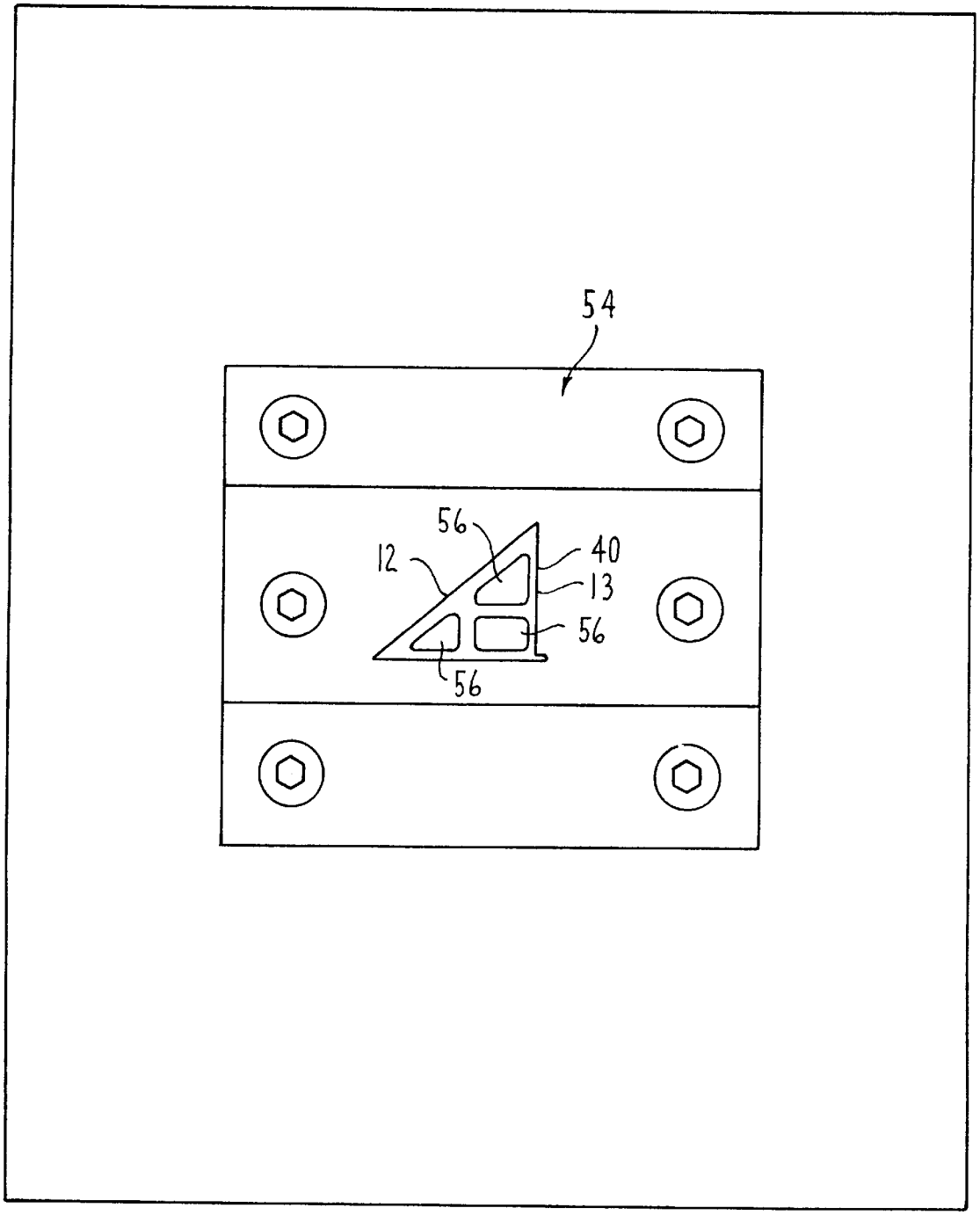
FIG. 7 is a plan view showing the blank on a stamping die after windows have been punched in the blank.

The blank 40 is initially stamped from type 302 stainless steel sheet (Rockwell C hardness of 49–51) that is 0.030 inch in thickness as illustrated in FIGS. 6 and 7. FIG. 6 shows a narrow sheet S of type 302 stainless steel on a lower stamping die 50 of a conventional stamping press with an initial solid triangular shaped blank 40 of the cutting blade stamped therefrom using an upper punch (not shown) of appropriate configuration. FIG. 7 shows the initial triangular shaped blank 40 on a second stamping die 54 of a conventional stamping press having an upper punch (not shown) configured to punch or pierce windows 56 in the blank 40. The punch is moved downwardly toward the die 54 to punch or pierce the open windows 56 in the blank 40 using a conventional stamping press. The flat blank thus has a triangular shape having straight cutting edge 12 forming the hypotenuse of the triangular blank shape, the elongated, axially extending base 11 and the rear base 13 extending normal to the base 11.

The punched flat blank 40 then is ground on a conventional grinding machine to form a bevels 11*c*, 12*c* (e.g. each bevel is 30 degrees) on each side of the cutting edges 11*b*, 12, FIGS. 2 and 5, along their lengths before the blank is formed to the final blade shape shown in FIGS. 1–4.

Figure 8:
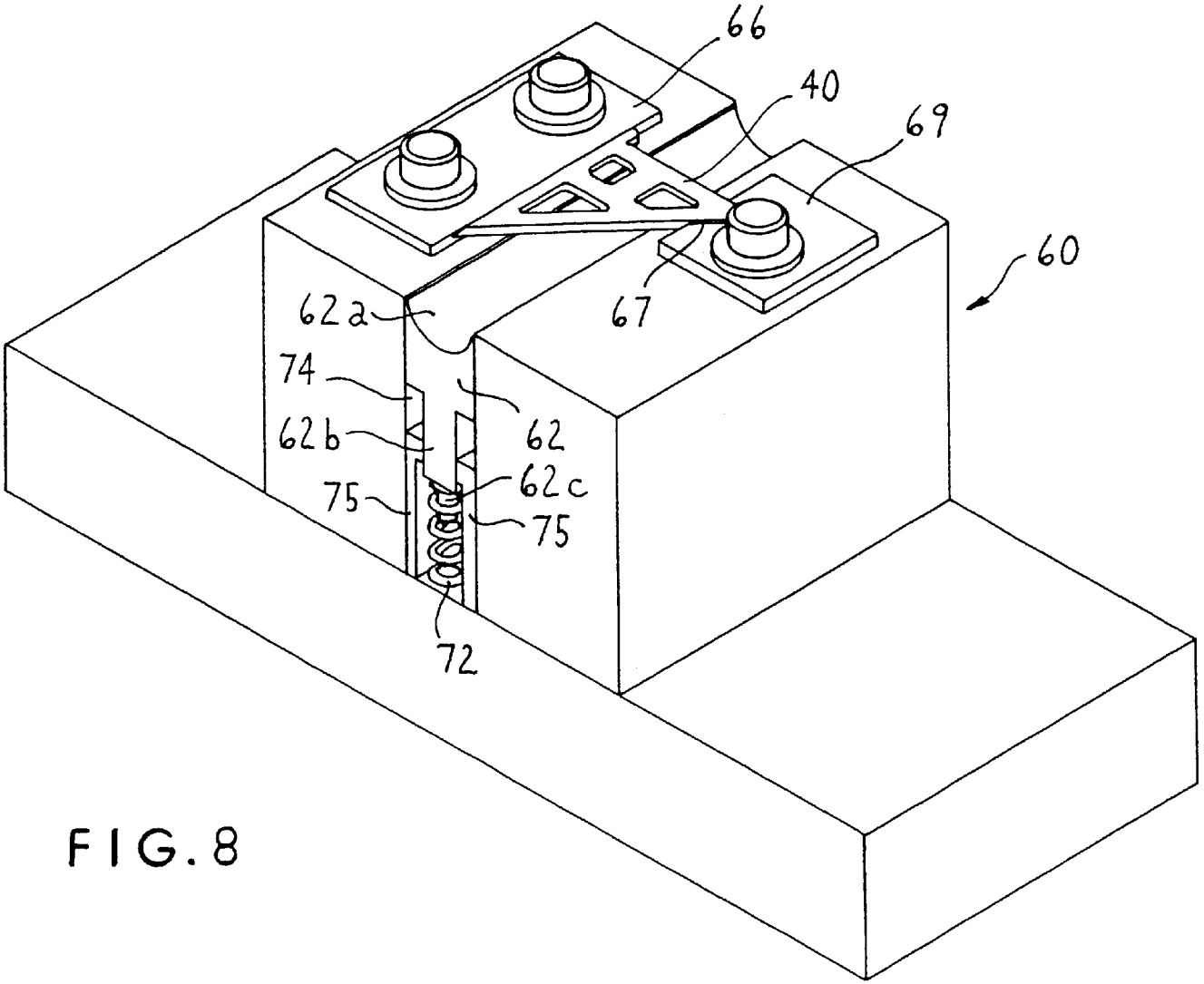
FIG. 8 is a perspective view of the punched and ground blank on a bending device.
Figure 8A:
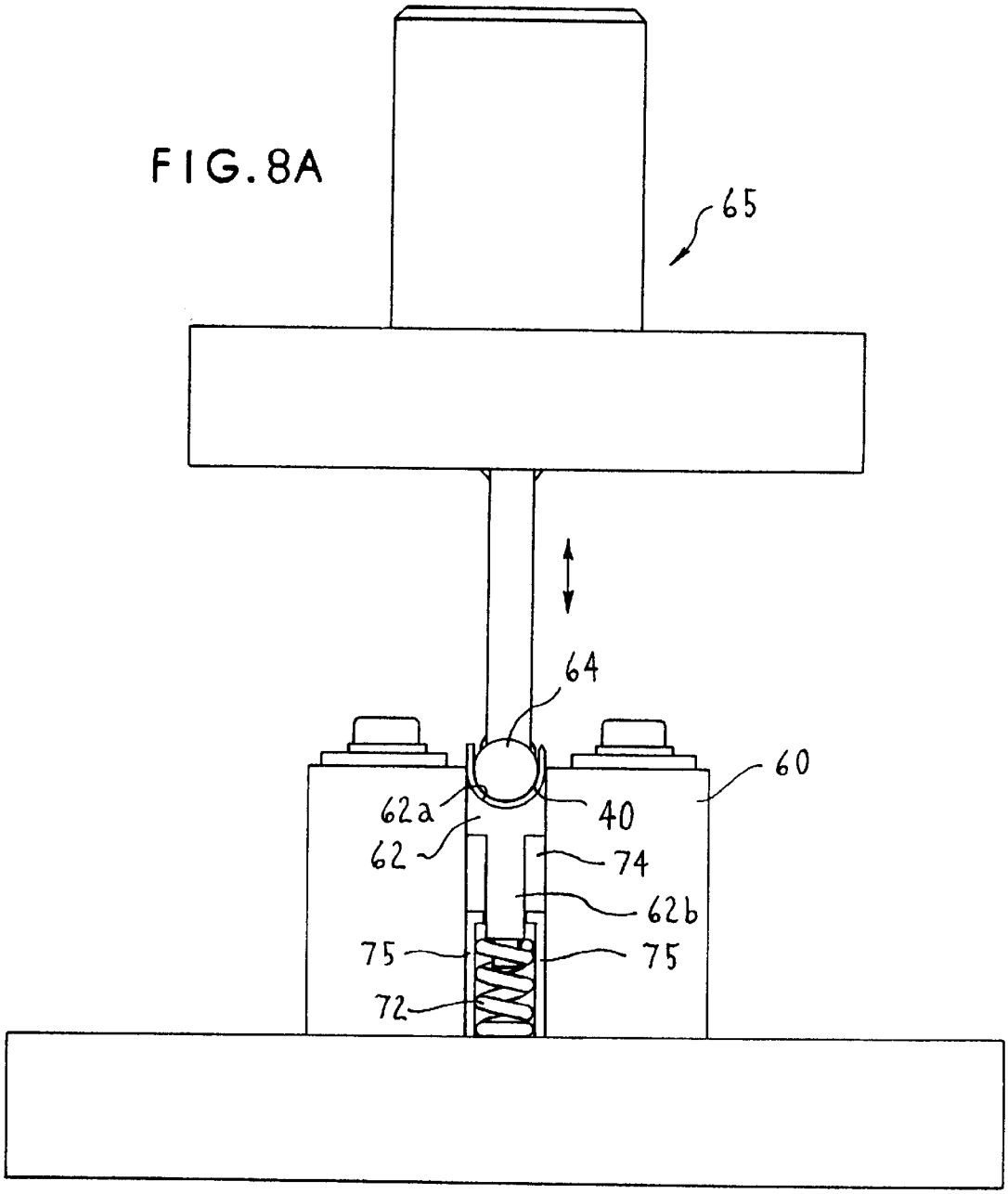
FIG. 8A is an elevational view of the blank after bending to a U-shape on the bending device.
Figure 9:
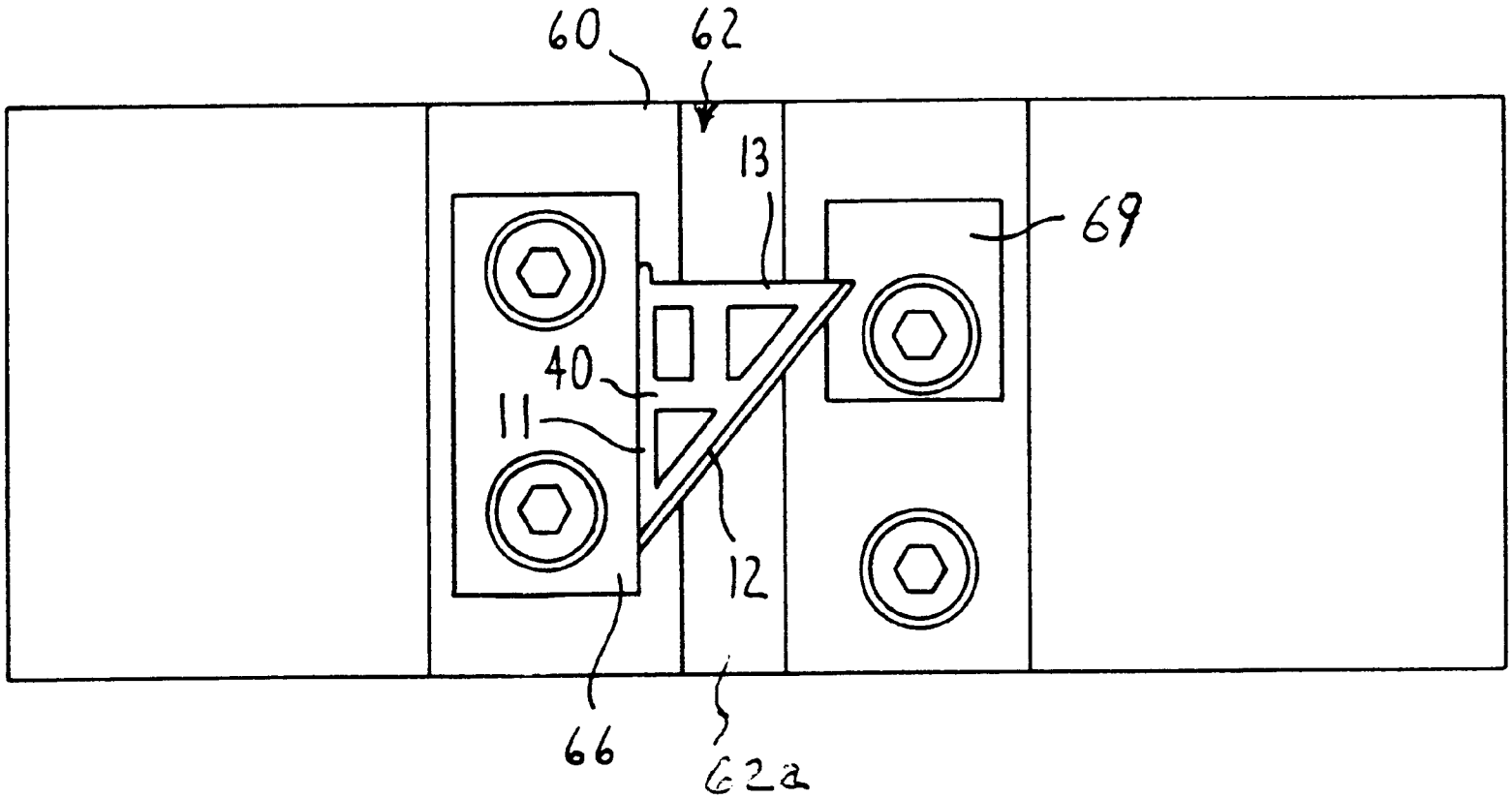
FIG. 9 is a plan view of the flat punched and ground blank on the bending device before bending.

After the grinding operation, the flat blank 40 is bent to a U-shape using a bending device illustrated in FIGS. 8, 8A, and 9.

In particular, the blank 40 is placed on a lower die 60 having a having a spring-biased shaft 62 with a radius-defined concave cavity 62*a* adapted to receive a cylindrical bending mandrel 64, FIG. 8A, and the bent blank 40. For purposes of illustration only, the mandrel 64 has an outer diameter of 0.514 inch and length of 2.4 inches perpendicular to the plane of the drawing. Prior to bending, the base 11 of the flat blank 40 is positioned against a linear locating plate 66 and in a triangular locating slot 67 in a plate 69 on the die 60, while spring biased shaft 62 is positioned beneath the blank 40. The cavity 62*a* is configured to receive the blank 40 as it is bent by mandrel 64, FIG. 8A. The mandrel 64 is affixed on a conventional press 65 and lowered thereby onto the blank 40 to engage near the midpoint of the dimension W of blank 40 and bend the blank about an axis generally parallel with the base 11 into a U-shape in the cavity 62*a* that has an internal radius to accept the blank 40 and mandrel 64 to this end. As the blank 40 is deformed into the cavity 62*a,* the shaft 62 is depressed against bias of a pair of springs 72 (one shown) disposed at each axial end of the shaft 62. The shaft 62 includes at each axial end a depending peg 62*b* (one shown) with each peg having an end 62*c* sized to be received within a respective coil spring 72 positioned by a respective pair of spring retainers 75 (one pair shown) in the die 60. The shaft 62 moves in space 74. The U-shaped blank 40 has an internal diameter corresponding to the outer diameter of the mandrel 64 at the location of greatest blank curvature.

Figure 10:
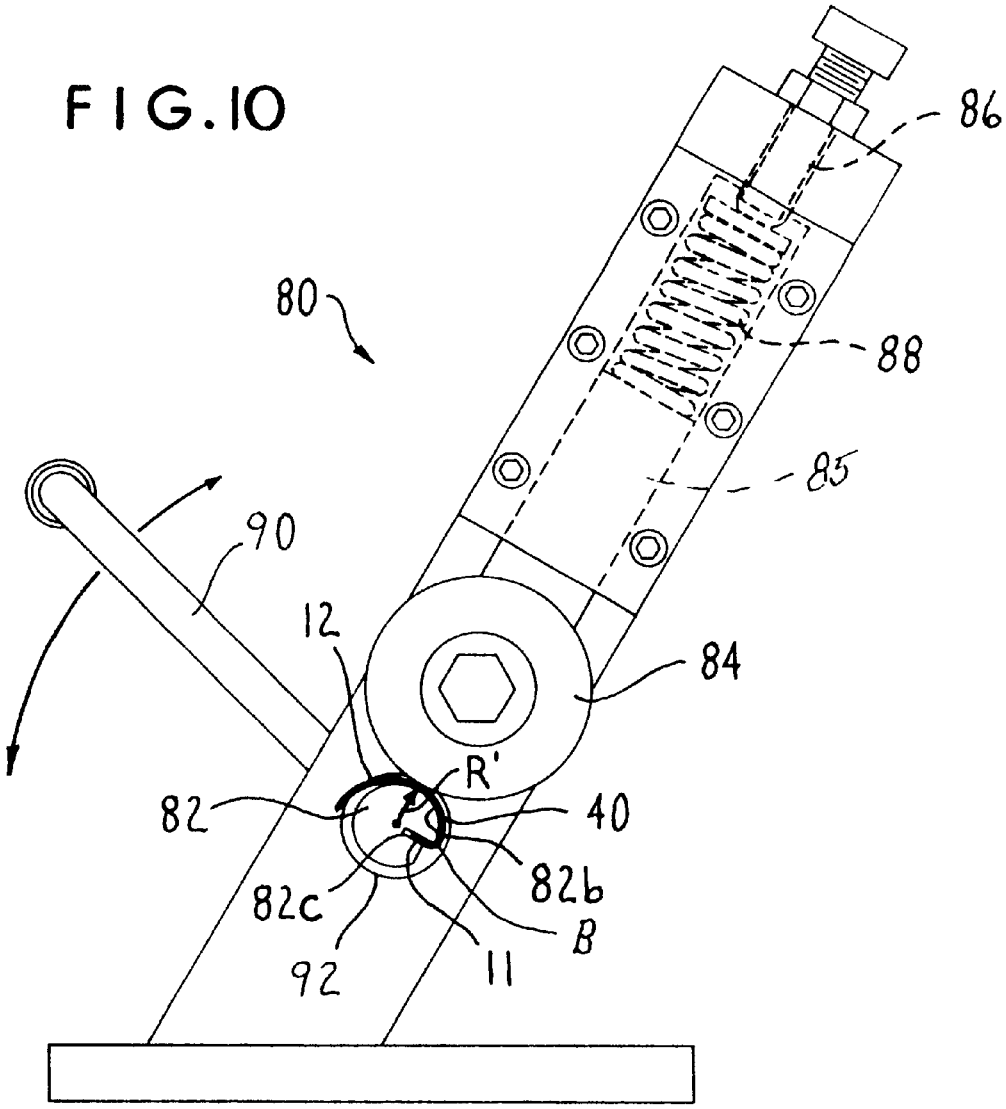
FIG. 10 is a side elevation of the bent blank on a second bending device.

After the U-shape is imparted to the blank 40, the blank is further bent using a second bending device 80 illustrated in FIG. 10. The blank 40 is placed on a rotatable, handle-operated mandrel 82 that cooperates with a freely rotatable follower wheel 84 disposed on shaft 85 to bend the blank 40. The mandrel 82 is connected to a handle 90 by which the mandrel is rotated. The handle 90 rotates in a bushing 92. The mandrel 82 has a surface 82*b* defined at least in part by a radius R' to impart the circular arc to the spiral cutting edge 12 and rear base 13 when the blade is viewed in end elevation. The mandrel includes a slot 82*c* in which the straight base 11 of the U-shape blank 40 is received and held during bending of the blank on the mandrel 82. The radius of mandrel surface 82*b* can be 5/16 inch (8 mm) and can be relieved (e.g. recessed) at appropriate circumferential regions to accommodate any spring back experienced by the deformed blank to achieve the circular arc configuration of cutting edge 12 and rear base 13 as viewed in end elevation. The follower wheel 84 has an outer diameter of 2.025 inches and is spaced from the mandrel surface 82*b* by the thickness of the blank 40 as controlled by a tension bolt 86 and spring 88 engaging shaft 85. The U-shaped blank 40 is initially slid axially on the mandrel 82 with the flat base 11 located in the slot 82*c*. The blank 40 is slid with the tip end or base end first on the mandrel depending upon the direction in which the cutting edge spiral is to extend. The handle 90 then is rotated to rotate the mandrel 82 and deform the blank between the mandrel 82 and follower wheel 84 to initially impart the bend B to the blank and then is further rotated to deform the spiral cutting edge 12 and the rear base 13 on the mandrel surface 82*b* to have the circular arc configuration as shown in FIG. 2, while the base 11 remains held flat in slot 82*c*. The slot depth is selected to locate the bend B at the appropriate location proximate the base 11 and impart the desired width D2 (e.g. D2=3.5 mm) to the base 11 during deformation of the blank between the mandrel and the follower wheel.

After bending to desired blade shape shown in FIGS. 1–4, each cutting edge 12 and rear base 13 has an outer diameter D of about 15 mm measured from outermost edge to outermost edge, or a radius R of 7.5 mm when viewed in end elevation as illustrated in FIG. 2.

When installed on the core member 20 as shown in FIG. 3, the three cutting edges 12 overlap circumferentially to an extent as best shown in FIGS. 3 and 4 such that the spiral cutting edges 12 collectively define a circular cutting envelope or profile of an outer diameter of 18.5 mm when viewed in end elevation in the direction of the leading tip 22. The outer cutting diameter of 18.5 mm is larger than the outer diameter of the individual cutting edges 12 as a result of the blades 10 being positioned and displaced radially outward in the slots 20*a* on the core member 20. The three cutting blades 10 thus will cut a circular profile hole of 18.5 mm diameter in an animal shot with the arrowhead.

Although the invention has been described with respect to certain embodiments, those skilled in the art will appreciate that modifications and the like can be made without departing from the scope of the invention as set forth in the appended claims.

What is claimed is:

1. A blade for an arrowhead, comprising a forward end and a rear end, an elongated, axially extending base between said forward end and said rear end, a spiral cutting blade intersecting said axially extending base proximate said forward end, and a rear base extending circumferentially between and intersecting said axially extending base and said spiral cutting edge at said rear end, said rear base being defined by a radius of a circle along its length between said axially extending base and said spiral cutting edge.

2. The blade of claim 1 wherein said axially extending base extends laterally along a diameter of a circle that is defined by said rear base.

3. The blade of claim 1 including a connecting web that extends between said axially extending base and said spiral cutting edge at an intermediate location between said forward end and said rear end of said cutting blade.

4. An arrowhead having a tip at a forward end, an elongated member having a plurality of axially extending slots, and a plurality of cutting blades, each cutting blade comprising an elongated, axially extending base that is received in a respective slot and a spiral cutting edge, each spiral cutting edge extending spirally about said elongated member and circumferentially overlapping the next adjacent spiral cutting edge to collectively define a circular cutting envelope when the arrowhead rotates.

5. The arrowhead of claim 4 wherein each said blade includes a rear base that extends circumferentially in a substantially circular arc between said axially extending base and said spiral cutting edge at their rear ends.

6. The arrowhead of claim 5 wherein each said axially extending base of each said blade extends laterally along a diameter of a circle that is defined by each respective said rear base.

7. The arrowhead of claim 4 wherein each said blade includes a connecting web that extends between said axially extending base and said spiral cutting edge at an intermediate location between said forward end and a rear end of each said cutting blade.

8. The arrowhead of claim 7 wherein each said blade includes an axially extending connecting web between said connecting web and said rear end of each said cutting blade.

9. A blade for an arrowhead, comprising a forward end and a rear end, an elongated, axially extending base between said forward end and said rear end, a spiral cutting blade intersecting said axially extending base proximate said forward end, and a rear base extending circumferentially between and intersecting said axially extending base and said spiral cutting edge at said rear end, said axially extending base extending laterally along a diameter of a circle that is defined by said rear base.

10. A blade for an arrowhead, comprising a forward end and a rear end, an elongated, axially extending base between said forward end and said rear end, a spiral cutting blade intersecting said axially extending base proximate said forward end, a rear base extending circumferentially between and intersecting said axially extending base and said spiral cutting edge at said rear end, and a connecting web that extends between said axially extending base and said spiral cutting edge at an intermediate location between said forward end and said rear end of said cutting blade.

11. The blade of claim 10 including an axially extending connecting web between said connecting web and said rear base of said cutting blade.

* * * * *